United States Patent [19]

Alonzo

[11] 4,426,078

[45] Jan. 17, 1984

[54] BOWLING ALLEY PITBOARD

[76] Inventor: Julius L. Alonzo, Marshall Heights, Mechanicville, N.Y. 12110

[21] Appl. No.: 215,323

[22] Filed: Dec. 11, 1980

[51] Int. Cl.[3] ..... A63D 5/02; A63D 5/10

[52] U.S. Cl. ..... 273/43 R

[58] Field of Search ..... 273/51, 43 R, 43 A; 15/238

[56] References Cited

U.S. PATENT DOCUMENTS

| | | | |
|---|---|---|---|
| 1,697,800 | 1/1929 | Treiber | 273/51 |
| 2,205,802 | 6/1940 | Scheidemantel et al. | 273/54 R |
| 3,188,085 | 6/1965 | Rogers et al. | 273/43 R |
| 3,861,674 | 1/1975 | Buck | 273/DIG. 4 X |
| 3,880,424 | 4/1978 | Bockelman | 273/43 R |

OTHER PUBLICATIONS

Brunswick Corp. Automatic Pinsetter Service Manual No. 12-752828, (undated).

*Primary Examiner*—Anton O. Oechsle
*Attorney, Agent, or Firm*—Heslin & Watts

[57] ABSTRACT

A pitboard which is installed in a bowling alley between the lane and the pin and ball pickup having a hard slippery surface which facilitates the rolling and sliding of the pins and balls. The pitboard has a foam core for absorbing sound, and the pin-supporting surface is textured with smooth raised surfaces which permit dirt particles and oil to accumulate between them.

14 Claims, 8 Drawing Figures

BOWLING ALLEY PITBOARD

BACKGROUND OF THE INVENTION

This invention relates to bowling machines and, more particularly, the pitboards used in the present day automatic bowling machines.

With the advent of automatic bowling machines came the pitboard which was used to direct the bowling pins and balls to the automatic pickup. Such a pitboard needed a number of very special characteristics. It had to absorb sound since the noise created by the impact of pins and balls on a multiplicity of adjacent lanes would be deafening. Typically, the pit area would be subject to a large number of dirt and dust particles and, often, oil drippings from the pinsetter which generally overhangs it. Thus, the pitboard would have to prevent the dirt and oil from being picked up by the bowling balls, thereby aiding the return of a clean ball to the bowler. In addition, the board also had to be capable of withstanding the constant impacts to which it would be subject. The pitboard also had to be effective in facilitating the movement of pins and balls discharged from the bowling lane through the pit area to the pickup.

The industry initially made pitboards with a hard material such as wood and, more recently, fiberglass or a high grade plastic which provided the strength and durability needed. To meet the other requirements, the prior art solution has generally involved the application of a rubber pad covered by a carpet, or more recently, artificial turf, to the pin-supporting side of the pitboard. This solution, of course, solved the noise problem and was also effective in preventing the balls from getting dirty or oily, providing the carpets were cleaned and shampooed regularly. As can be expected, the wear on these surfaces was considerable especially since most balls thrown down the lane hit the pit cushion and then drop onto the pitboard, causing a line of excessive wear under the pit cushion. This, combined with general wear and tear, necessitates the annual replacement of the surface. The replacements involve removing the pitboards and ripping off the carpets and rubber pads glued thereto, cutting the replacement carpet or turf, preparing the surface for regluing, and regluing the replacement pad and carpet to the board with a quart of adhesive. This replacement procedure proves to be very time consuming, sometimes necessitating the closing of the lanes for one or two days. Furthermore, the replacement materials are very costly and are a financial burden, especially when reconditioning covers 30 or so lanes annually. Once installed, the new carpets create another problem due to the lint which they shed, and this problem lasts until they are broken in.

Prior art pitboards of the type herein discussed are generally mounted in the pit area on a shaker assembly which serves to impart a reciprocating motion to the board. Although pitboards generally slope downwardly from the lane to the pin pickup, the pins, without the aid of the shaker assembly, generally would be prevented by friction between themselves and the pitboard carpet from reaching the pin pickup at the rear of the pit. But these arrangements have been only partially successful. Virtually everyone who has bowled has had the experience of not getting their ball back. This usually occurs when the ball is blocked by some pins in the pit or due to the fact that they have not been delivered by the pitboard to the pickup. Therefore, the operator of the bowling facility must have someone constantly available to remedy the problem. Also, since some pins can get blocked, relatively permanently, while still permitting the ball to be returned, a condition can develop wherein there are an insufficient number of pins to fill all the sockets in the overhead pin setter. This problem can be overcome to a reasonable degree by adding extra pins to the machine so that there always will be a full complement to set up even if several are blocked. Although this adds an additional cost, it is generally preferred over the alternative of disgruntled customers who have to wait for someone to fill the pins before their next frame can be set up. Adding a further burden is the fact that the shaker assemblies often have their drive belts or bearings wear out due to the excessive weight of the pitboard driven by the assembly. When this occurs, it precludes the use of the entire machine, since a conventional pitboard alone cannot satisfactorily convey the pins and balls through the pit area.

This invention solves all the foregoing problems of the present-day pitboards while supplying the necessary characteristics that an effective pitboard must have.

SUMMARY OF THE INVENTION

The foregoing shortcomings of the prior art can be avoided and certain new advantages and results can be obtained in accordance with the present invention which centers in my novel pitboard and is based on my new discoveries to be described.

Thus, an object of my new invention is to provide a pitboard which is economical both in its manufacture and use.

Another object of this invention is to provide a pitboard which is maintenance-free and durable.

Another object of this invention is to provide a surface for a pitboard which will speed the movement of pins and balls through the pit area to the pin and ball pickup.

Yet another object of this invention is to provide a surface which will tend to prevent dirt particles or oil on the pitboard from being picked up by the bowling pins and balls.

A still further object of this invention is to minimize the amount of noise caused by the impact of the pins and balls upon the pitboard.

Another object of this invention is to provide a pitboard that is efficient enough in operation to permit the bowling machine, of which it is a part, to function reasonably well, even when the shaker assembly is disabled.

Briefly described, the pitboard is molded as a single continuous unit adapted to be installed in an automatic bowling machine. The pin-supporting surface is made of solid material which is textured in smooth raised surfaces so as to permit bowling pins and balls to slide and roll thereon while also permitting dirt particles and oil to accumulate between the raised surfaces. In the usual preferred embodiment, the pitboard has a foam core to absorb the sound caused by the impacting pins and balls.

When this pitboard is used in combination with a conventional bowling machine, the method of moving the pins and balls through the pit area will be greatly enhanced. Once the pitboard is placed between the end of the bowling lane and the pin and ball pickup, said board being downwardly inclined from the lane to the pickup, it will serve to catch the pins and balls which fall into the pit. After impacting upon the pitboard, the pins and balls with roll and slide on the solid pin-supporting surface which is textured in smooth raised surfaces, and easily reach the pickup.

DETAILED DESCRIPTION OF THE INVENTION

Figure 1:
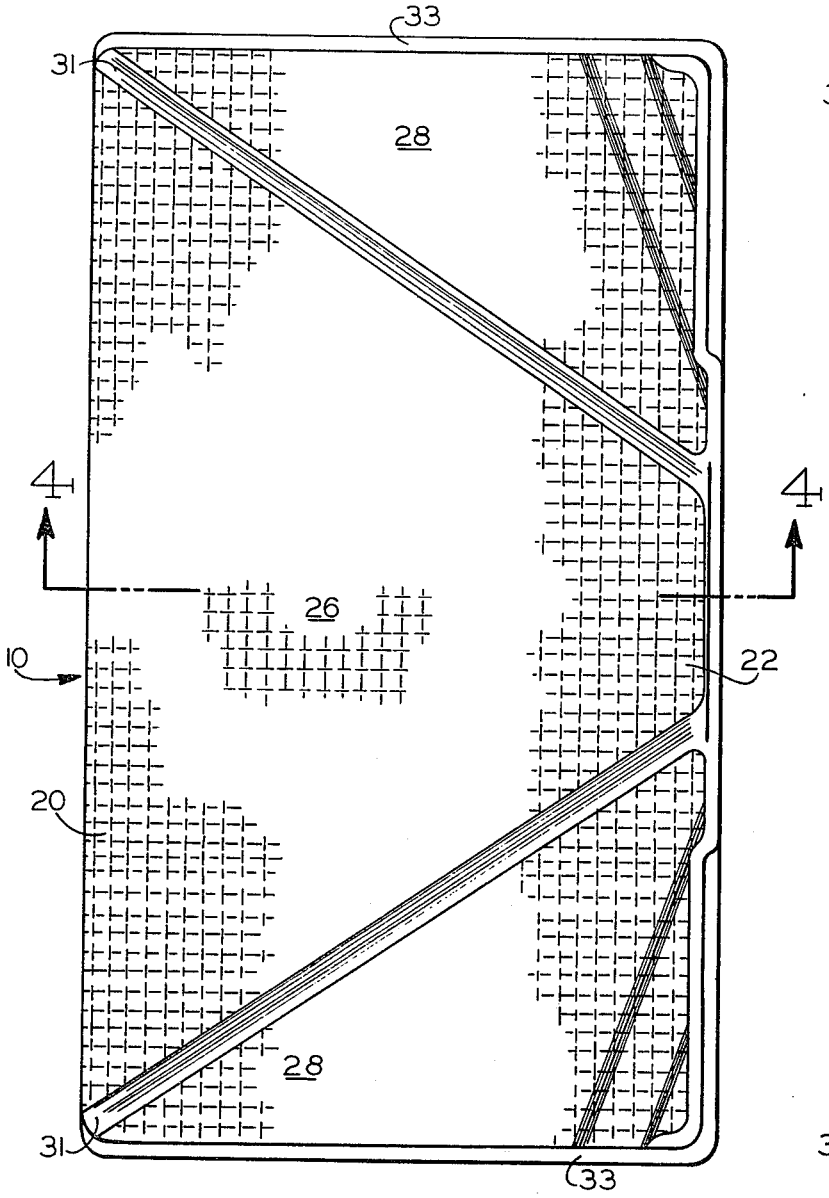
FIG. 1 is a top plan view of the invention.

FIG. 1 shows a pitboard 10 which is rectangular in shape and adpated for use in a conventional Brunswick bowling machine. For a description of such a machine, reference is made to the service manual for the Brunswick Automatic Pinsetter, Identification No. 12-752828.

Figure 6:
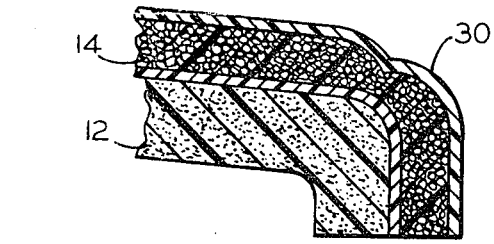
FIG. 6 is a magnified view of the material used in the invention.
Figure 7:
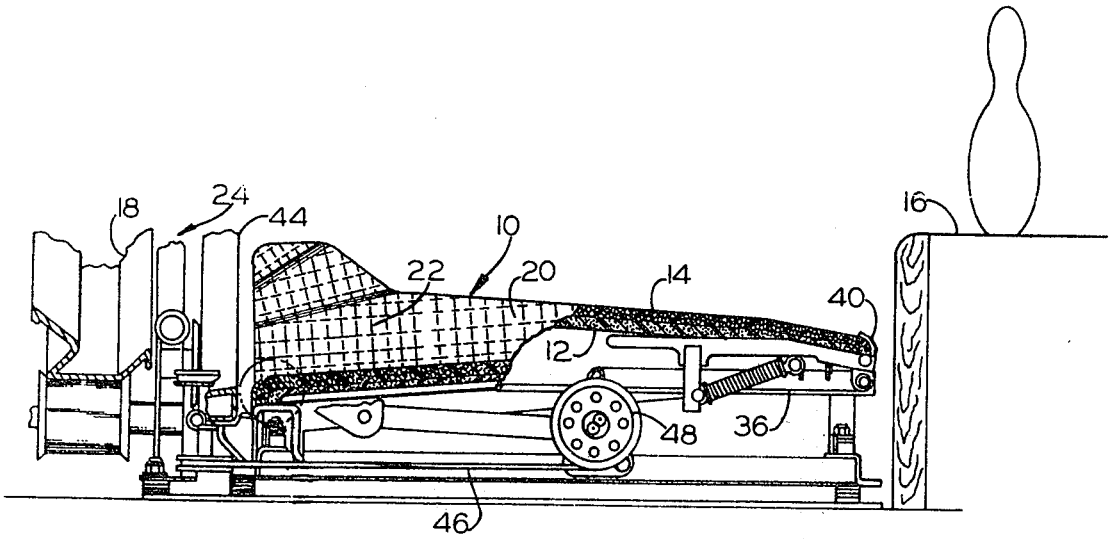
FIG. 7 is a cross-sectional view of the invention in place in an automatic bowling machine.
Figure 8:
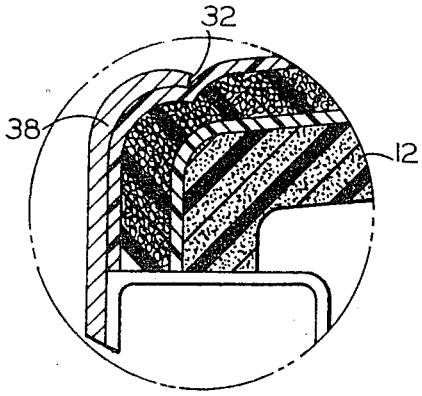
FIG. 8 is an enlarged view, taken from FIG. 7, showing the rear portion of the invention connected to the frame.

This pitboard is the result of a series of experiments and tests which began with the replacement of the pitboards presently used with a piece of molded organic polycarbonate resin. While apparently solving some of the problems of the present-day pitboard, testing showed that this material did not provide some of the desirable attributes of the rug-covered pitboard. The impact of bowling pins and balls was quite loud and, furthermore, the dirt particles and oils which landed on the pitboard were easily picked up by the balls and pins. It was discovered at this time, however, that the noise problem could be solved through the application of a foam padding 12 to the underside of the pitboard, thus supplying a sufficient degree of noise absorption. (See FIGS. 6 and 7). It was later discovered that a foam core 14, as shown in FIGS. 6 and 7, was also efficient in absorbing the sound created by the impact of the bowling pins and balls. A material which I have found to be very satisfactory for the preferred embodiment of this invention is readily available in a synthetic plastic sold under the mark ROYALITE 800 by Uniroyal, Inc. This material has solid outer surfaces and a foam core to increase rigidity and impact strength at low cost, but which also, and fortunately for our purposes, absorbs sound. Should greater sound absorption be required, it will be appreciated that a pitboard with foam core 14 can also be fashioned with a foam padding 12 on its underside, thus creating a greater sound deadening effect.

FIG. 7 shows the pitboard in its installed position, and for the purposes of this application, I refer to the side of the pitboard near the lane 16 as the front and the side near the pin wheel pickup 18 as the rear. The pitboard is positioned so as to slope from front to rear so that the balls and pins will move through the pit area. I have greatly increased this movement through the use of a pin-supporting surface 20 which is textured in smooth raised surfaces 22. These smooth raised surfaces 22 also permit dirt particles and oil to accumulate between them while minimizing contact between the pitboard and the pins and balls such that the dirt and oil is less likely to adhere to the pins or balls. When used in conjunction with a slippery surface, such as smooth ROYALITE 800, the pins slide and roll through the pit area to the pickup 24. I have found that this improved delivery of the pins and balls to the pickup eliminates the need for extra pins and requires less attention since the pins are rarely stopped on their way to the pin wheel 18. Furthermore, the use of a slippery surface promotes a quicker ball return, thereby saving time and speeding up the play of the game. Finally, I was pleasantly surprised to find that my new pitboard is efficient enough in operation to permit a bowling machine to continue functioning reasonably well even if its shaker assembly is out of order.

Figure 2:
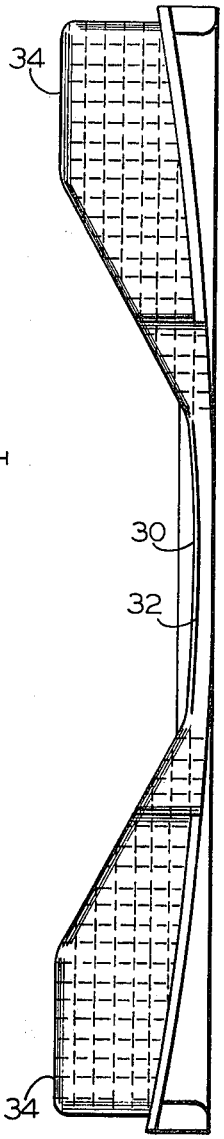
FIG. 2 is a rear elevational view.
Figure 3:
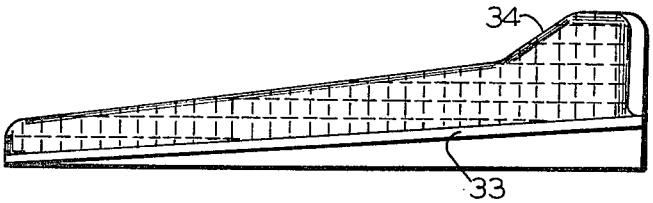
FIG. 3 is a side elevational view.
Figure 4:
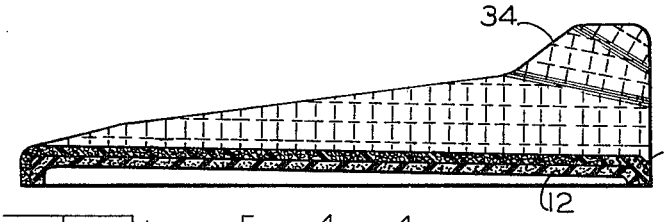
FIG. 4 is a cross-section taken along lines 4—4 in FIG. 1.
Figure 5:
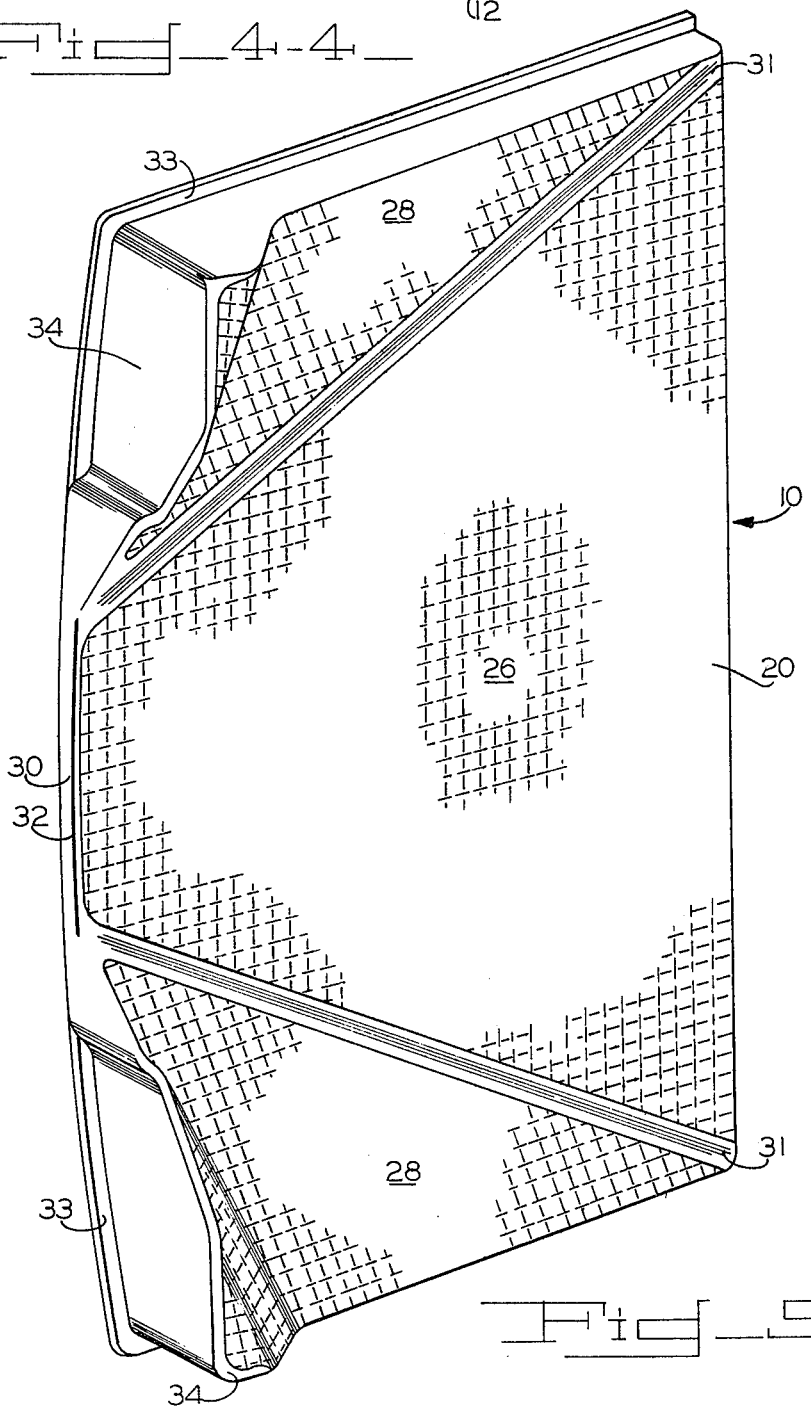
FIG. 5 is a perspective view of the invention.

In making my pitboard, I have found it advantageous to mold the material so that there are three sections, namely, center section 26 and side sections 28. (See FIG. 5). I prefer to have center section 26 slightly concaved in order to move the pins and balls towards the center of the pitboard 10. The side sections 28 are triangular in shape, as shown, and slope downwardly toward the center section 26. (See FIGS. 2 and 5). The sloping of the side sections 28 effectively directs the pins and balls to center section 26 which funnels them for discharge from the rear center portion 30 of the pitboard. Running along the rear center portion 30 is a recess 32. The rear corners of the pitboard are raised, thus forming deflectors 34 as shown in FIG. 5. These deflectors 34 prevent the discharge of the pins and balls from the rear corners of the pit area.

In the preferred embodiment, the pitboard 10 has ribs 31 and flanges 33 for added strength. One such rib lies between the center section 26 and each side section 28. Each rib is approximately 1–2 inches wide and resembles a smooth step between a side section 28 and center section 26. As an alternative, the ribs could be replaced by simple creases where the sections 26 and 28 come together at an angle. Each flange 33, as seen in FIG. 5, extends along the side of the pitboard 10 and continues along the rear for a distance equal to approximately one-fourth the entire length of the pitboard.

As shown in FIG. 7, the pitboard 10 is positioned on shaker assembly frame 36. The pitboard is secured in place by rear clamp 38 which engages recess 32, as shown in the enlargement, and front clamp 40 which engages the front edge of the pitboard. The pitboard is positioned in the bowling machine between bowling lane 16 and the ball and pin pickup mechanism generally designated as 24, which includes ball wheel 44 and pin wheel 18. Only portions of these structures are shown since they are conventional parts of existing equipment and my purpose here is merely to show the relationship between them and my pitboard. A pitboard shaker assembly including a drive belt 46 and a shaker pulley 48 lie beneath the pitboard and serve to vibrate the pit frame. No attempt is made to describe the shaker assembly since it is well-known to those in the art and for the purpose of this invention, it is sufficient to realize that it imparts a shaking motion to the pitboard. The amount of wear on the conveyor belt 46 and the shaker pulley 48 is, of course, related to the weight of the pitboard which it is shaking. The life expectancy of these parts is therefore extended when using my invention which weighs less than half the weight of the many prior art pitboards.

In operation, the bowling pins and balls from lane 16 impact upon the pin-supporting surface 20 of the pitboard 10. Those pins and balls which impact on side section 28 or deflectors 34 are redirected to the center section 26 of the pitboard 10. The downwardly inclined positioning of pitboard 10 along with the smooth raised surfaces 22 of slippery material cause the pins and balls to slide and roll toward the rear of the pitboard. This movement is aided by the shaking of the pit frame 36 by the pitboard shaker assembly. The pins and balls roll and slide over the recess 32 and into the pin wheel 18 and ball wheel 44, respectively.

Changes and modifications in the specifically described embodiments can be carried out without departing from the scope of the invention which is intended to be limited only by the scope of the appended claims.

What is claimed:

1. A pitboard adapted to be installed in the pit of an automatic bowling machine, said board having a pin supporting and contacting surface made of hard and slippery material which is textured in smooth raised surfaces surrounded by depressed areas so as to permit bowling pins and balls to slide and roll thereon while also permitting dirt particles and oil to accumulate between the raised surfaces.

2. The invention of claim 1 wherein the pitboard has a foam core for the absorption of sound as pins and balls impact on the pin-supporting surface.

3. The invention of claim 1 or 2 wherein the pitboard is provided with a foam backing on its underside for the absorption of sound as pins and balls impact on its pin-supporting surface.

4. The invention of claim 1 or 2 wherein the pitboard is molded as a single continuous unit adapted and ready to be installed in an automatic bowling machine.

5. A pitboard to be installed in the pit of an automatic bowling machine, said board having a pin supporting and contacting surface made of a smooth hard and slippery material so as to permit bowling pins and balls to slide and roll thereon, and having sound absorbing means located beneath the pin supporting surface.

6. The invention of claim 5 wherein said pin supporting surface is textured with smooth raised surfaces surrounded by depressed areas so as to permit bowling pins and balls to slide and roll thereon while also permitting dirt particles and oil to accumulate between the raised surfaces.

7. The invention of claim 5 or 6 wherein the sound absorbing means comprises a foam core contained within the pitboard.

8. The invention of claim 5 or 6 wherein the sound absorbing means comprises a foam backing on the underside of the pitboard.

9. The invention of claim 1 or 6 wherein the pin-supporting surface includes:

a center section to funnel the pins and balls to the automatic bowling machine;

two side sections each downwardly inclined toward the center section; and a rib between the center and each side section.

10. A method of moving bowling pins and balls from the end of a bowling lane to the pit area of an automatic bowling machine so as to feed them to a pin and ball pickup which comprises:

placing a pitboard in the pit area between the end of the bowling lane and the pin and ball pickup, said board being downwardly inclined from the lane to the pickup and having a pin supporting and contacting surface of hard and slippery material which is textured with smooth, raised surfaces surrounded by depressed areas;

catching the pins and balls which fall into the pit on the pitboard; and permitting the pins and balls to roll and slide on the pitboard toward the pickup.

11. The method of claim 10 which further comprises the further step of shaking the pitboard so as to promote the movement of the pins and balls to the pickup.

12. In an automatic bowling machine:

a pit area, located at the end of a bowling lane, for receiving bowling pins and balls discharged from the lane;

a pin and ball return mechanism for receiving pins and balls from the pit area and for resetting the pins and returning the balls to the bowler; and a pitboard adapted to be installed in the pit area; between the end of the lane and the pin and ball return mechanism, to catch the pins and balls which fall into the pit area and convey them to the pin and ball return mechanism, said pitboard having a pin supporting and contacting surface made or hard and slippery material which is textured with smooth raised surfaces surrounded by depressed areas so as to permit bowling pins and balls to slide and roll thereon while also permitting dirt particles and oil to accumulate between the raised surfaces.

13. The invention of claim 12 wherein the pin and ball return mechanism inlcudes a pitboard shaker assembly extending into the pit area and wherein said pitboard is installed thereon.

14. The invention of claim 13 wherein the shaker assembly includes a pit frame for holding the pitboard and the pitboard is adapted to be engaged by the pit frame.

* * * * *